US005275340A

United States Patent [19]

Haruch

[11] Patent Number: 5,275,340

[45] Date of Patent: * Jan. 4, 1994

[54] SPRAY NOZZLE WITH RECESSED DEFLECTOR SURFACE

[75] Inventor: James Haruch, Naperville, Ill.

[73] Assignee: Spraying Systems Co., Wheaton, Ill.

[ * ] Notice: The portion of the term of this patent subsequent to Mar. 2, 2010 has been disclaimed.

[21] Appl. No.: 987,001

[22] Filed: Dec. 7, 1992

Related U.S. Application Data

[63] Continuation-in-part of Ser. No. 715,438, Jun. 14, 1991, Pat. No. 5,190,222.

[51] Int. Cl.[5] ..... B05B 1/26

[52] U.S. Cl. ..... 239/523; 239/524; 239/550; 239/DIG. 1

[58] Field of Search ..... 239/432, 434, 510, 512, 239/523, 524, 553.3, DIG.

[56] References Cited

U.S. PATENT DOCUMENTS

| | | | |
|---|---|---|---|
| 3,082,961 | 3/1963 | Hruby, Jr. | 239/523 |
| 3,085,754 | 4/1963 | Thompson | 239/523 |
| 3,342,423 | 9/1967 | Hruby, Jr. et al. | 239/590.5 |
| 3,864,652 | 12/1968 | O'Brien et al. | 239/524 |
| 4,185,781 | 1/1980 | O'Brien | 239/600 |
| 4,353,508 | 10/1982 | Butterfield et al. | 239/590.3 |
| 4,356,974 | 11/1982 | Rosenberg et al. | 239/524 |
| 4,815,665 | 3/1989 | Haruch | 239/432 |
| 4,828,182 | 5/1989 | Haruch | 239/432 |
| 4,899,937 | 2/1990 | Haruch | 239/432 |
| 5,190,222 | 3/1993 | Haruch | 239/523 |

*Primary Examiner*—Karen B. Merritt
*Attorney, Agent, or Firm*—Leydig, Voit & Mayer

[57] ABSTRACT

A spray nozzle assembly having a spray tip formed with an elongated, cylindrical chamber communicating with the liquid supply and being formed with a cross-slot which intersects the chamber at a location intermediate the ends thereof for defining a discharge orifice, a deflection surface on a downstream side of the discharge orifice for directing liquid in a direction transverse to the axis of the chamber, and a pocket extending downstream of the deflector surface. In one embodiment, the spray tip has a preorifice substantially smaller in diameter than the chamber adjacent an upstream end thereof, in another embodiment, the chamber is disposed with its axis at an angle to the vertical and the cross-slot extends upwardly in substantially vertical relation for defining a vertical deflection surface, and in still another embodiment the spray tip has a wear resistant metal insert.

22 Claims, 5 Drawing Sheets

SPRAY NOZZLE WITH RECESSED DEFLECTOR SURFACE

This application is a continuation-in-part of application Ser. No. 07/715,438, filed Jun. 14, 1991, now U.S. Pat. No. 5,190,222.

FIELD OF THE INVENTION

The present invention relates generally to spray nozzles, and more particularly, to spray nozzle assemblies of the type which have a spray tip with a transversely oriented deflector flange formed with a distinct recess or pocket for the purpose of effecting a particular desired liquid distribution in the discharging spray.

BACKGROUND OF THE INVENTION

Spray nozzle assemblies are known, such as shown in U.S. Pat. No. 4,899,937 assigned to the same assignee as the present invention, which include a deflector flange that enhances particle breakdown and directs the spray pattern in a transverse direction. The deflector flange of the nozzle shown in the aforesaid U.S. Patent is formed with a distinct recess or pocket in axial alignment with the liquid discharge orifice in the nozzle tip, which has been found to generate a spray pattern that has shallow bell-shaped liquid distribution curve with greatest quantities of liquid being directed in a central portion of the spray pattern and lesser quantities on opposite sides thereof so that overlapping spray patterns from a plurality of such nozzles mounted in laterally spaced relation to each other, such as on the boom on an agricultural sprayer, produce a substantially uniform distribution of liquid over the area being sprayed.

In hydraulic spraying applications, namely applications in which the liquid flow stream is not subject to air-assisted pre-atomization, such nozzles have been found to be susceptible to excessive wear that can alter the spray characteristics and substantially increase the liquid flow. Although wear is reduced if the liquid is pre-atomized by pressurized air prior to direction through the nozzle spray tip, such air assisted spraying generates a fog-like discharge of relatively fine liquid particles. In agricultural applications, unless such discharging spray is directed in a substantially straight downward direction, the fine liquid particles are subject to undesirable drift. Heretofore, it often has not been possible to easily mount such spray nozzles for straight downwardly directed spraying, particularly on booms which are adapted for vertical spray nozzle mounting. Since the deflector flange of the nozzle is disposed transversely to the discharge orifice, such nozzles also have been susceptible to clogging by solid materials that might be included in the liquid being sprayed.

OBJECTS AND SUMMARY OF THE INVENTION

It is an object of the present invention to provide a spray nozzle assembly with a spray tip having a recessed deflector flange that may be utilized for hydraulic spray applications to generate a controlled shallow bell-shaped liquid distribution with less susceptibility to wear.

Another object provides a spray nozzle assembly as characterized above which can be easily mounted on an agricultural spray boom for directing the discharging spray in a substantially straight downward direction, without tedious adjustment or manipulation of the nozzle during mounting.

A further object is to provide a spray nozzle assembly of the above kind that is adapted for spraying solids containing liquids with less tendency for clogging.

Other objects and advantages of the invention will become apparent upon reading the following detailed description and upon reference to the drawings, in which:

Figure 1:
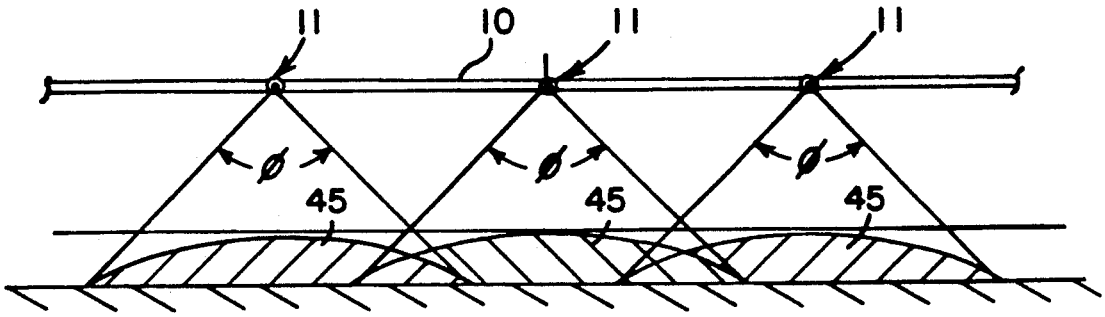
FIG. 1 is a partially diagrammatic depiction of the performance of a plurality of nozzles assemblies embodying the present invention mounted in laterally spaced relation to each other on a spray boom, with the liquid distribution curve of each nozzle assembly depicted below the respective nozzle assembly.

While the invention is susceptible of various modifications in alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalence falling within the spirit and scope of the invention.

DESCRIPTION OF THE PREFERRED EMBODIMENTS

Figure 2:
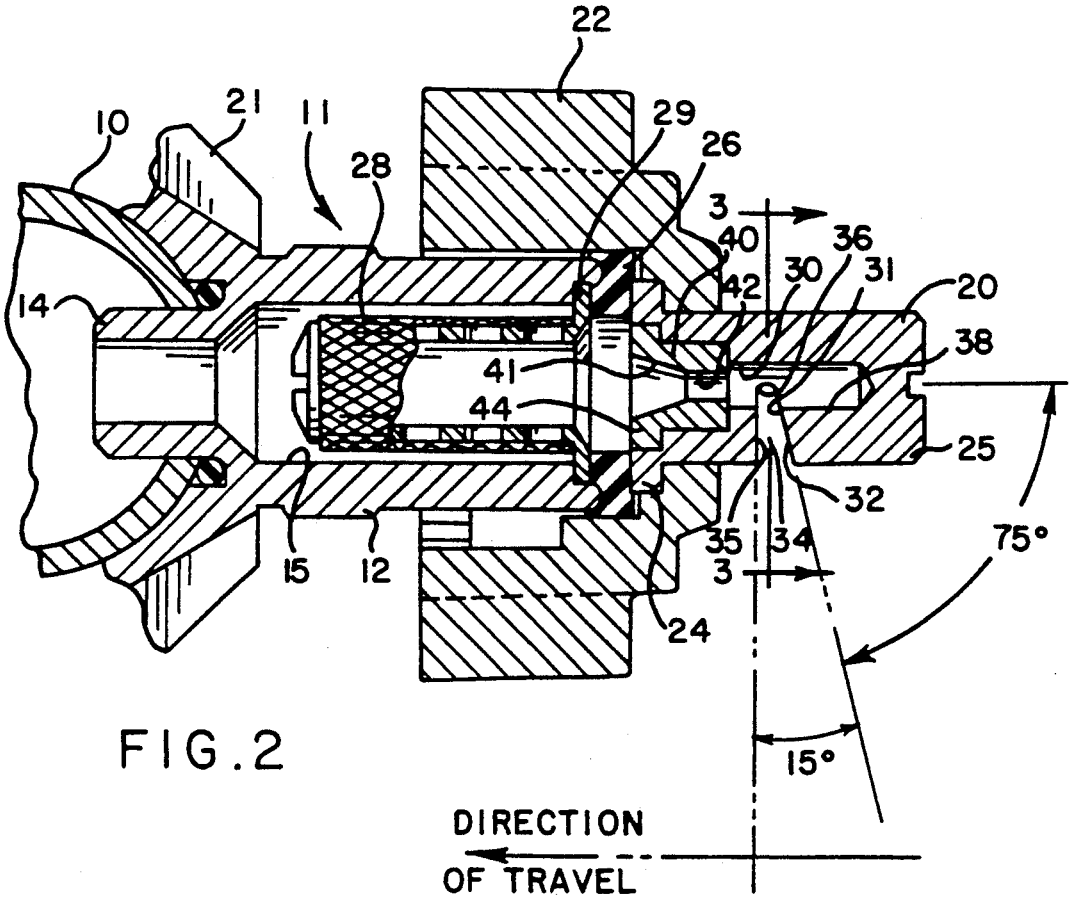
FIG. 2 is an enlarged fragmentary section of one of the spray nozzle assemblies.
Figure 3:
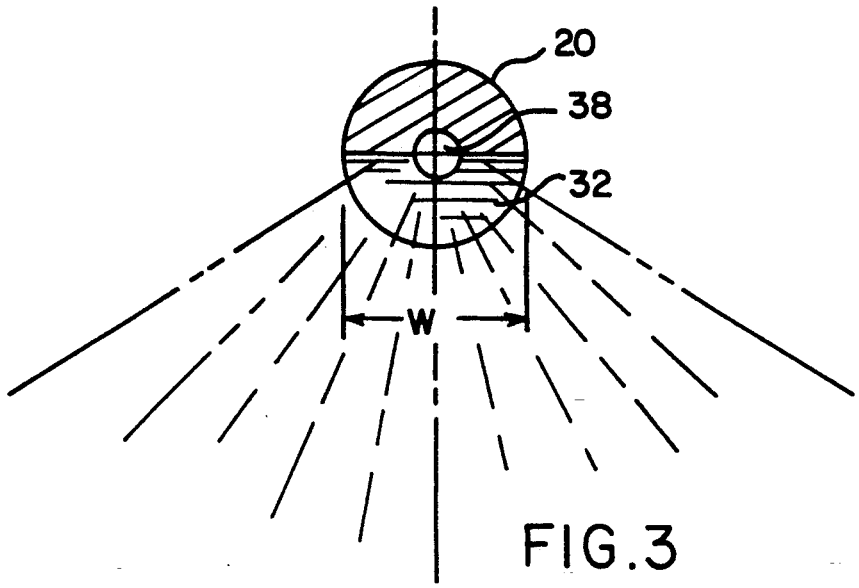
FIG. 3 is an enlarged vertical section of the spray tip of the nozzle assembly shown in FIG. 2, taken in the plane of 3—3.

Referring now more particularly to FIGS. 1-3 of the drawings, there is shown a spray boom 10, such as the boom of an agricultural sprayer, having mounted thereon a plurality of spray nozzle assemblies 11 in accordance with the invention. The boom 10 in this instance is a tubular member through which the supply liquid is directed. Each spray nozzle assembly 11 includes a stem 12 having a nipple 14 extending into the boom 10 through an aperture in one side thereof. Pressurized liquid supplied to the boom 10 enters the stem 12 through the nipple 14 and passes through a central fluid passageway 15 in the stem 12 for direction through and discharge from a spray tip 20 mounted at the outer end thereof. The stem 12 is secured to the boom 10 by appropriate means, such as a clamp 21.

For removably securing the spray tip 20 to the stem 12, a retention cap 22 is provided, which may be of the type disclosed in Butterfield et al. U.S. Pat. No. 4,527,745. The spray tip 20 has an outwardly extending flange 24 at its upstream end, seated in the cap 22 and a body portion 25 extending outwardly of the cap 22 through a central aperture therein. The retention cap 22 in turn is telescoped over the outer end of the stem 12. For locking the cap 22 and spray tip 20 in predetermined position on the stem 12, the stem 12 and cap 22 may be formed with cooperative locking lugs and slots as is known in the art. A resilient annular gasket 26 is interposed between the end of the spray tip mounting flange 24 and the end of the stem 12, and a strainer 28 is secured within the flow passageway 15 of the stem 12 with a mounting flange 29 thereof interposed between the resilient gasket 26 and a seat formed in the end of the stem 12. Liquid directed through the stem 12 passes through the strainer 28 prior to its direction through the spray tip 20.

The spray tip 20 is formed with an elongated chamber 30 that extends into the body 25 from an upstream end thereof for communication with the liquid passageway 15 in the stem 12. For defining a discharge orifice 31 and a deflection surface or face 32 for directing liquid in a downward direction transverse to the longitudinal axis of the stem 12 and spray tip 20, the spray tip 20 is formed with a cross slot 34 extending upwardly from an underside thereof. The cross slot 34 in this case defines a generally vertically directed upstream face 35 with the downstream deflection face 32 being oriented at an angle of about 15 degrees with respect to the vertical. The apex between the cross slot faces 32, 35 is connected by a round 36 preferably extending to the longitudinal axis of the spray tip chamber 30, which has been found to define a spray pattern with a relatively wide angle $\phi$ between about 120 and 130 degrees (FIG. 1) that is particularly desirable for agricultural spraying. Extending the cross slot 34 upwardly beyond the longitudinal axis of the chamber 30 has been effective for increasing the angle $\phi$ of the discharging spray pattern up to and approaching 180 degrees.

For enhancing liquid breakdown and atomization and for directing a discharging spray pattern with a shallow bell-shaped liquid distribution curve, the cross slot 34 intersects the chamber 30 intermediate the ends thereof for defining a significant recess or pocket 38 downstream of the discharge orifice 31 and deflector surface 32. The recess or pocket 38 extends beyond the deflector surface 32 a distance of at least twice, and preferably about 3 times the diameter of the chamber 30. While spray nozzles with recessed deflector flanges, such as shown in U.S. Pat. No. 4,899,937, have been found effective for generating sprays with bell-shaped liquid distribution curves, as previously indicated, when used in hydraulic, non-air-assisted spraying applications, such tips have been found to experience significant wear about the discharge orifice and deflector surface. As a result, use of such nozzles have been largely limited to air assisted spray applications in which a pre-atomized liquid flow stream is directed through the spray tip.

In accordance with the invention, the nozzle spray tip defines a pre-orifice upstream of the discharge orifice which is sized substantially smaller than the nozzle tip chamber such that the chamber and the deflector surface recess form an expansion chamber that facilitates breakdown and direction of the liquid particles with significantly reduced wear, while not substantially affecting the bell-shaped character of the liquid distribution of the discharging spray. To this end, in the illustrated embodiment, the spray tip 20 includes a pre-orifice member 40 that is press fit or otherwise secured in the upstream end of the spray tip 20. The pre-orifice member 40 is formed with an inwardly tapered entrance passageway or throat 41 for receiving supply liquid from the flow passageway 15 of the stem 12 and which communicates with a cylindrical pre-orifice 42 having a diameter preferably on the order of about ½ the diameter of the spray tip chamber 30 for throttling and accelerating liquid into the expansion chamber defined by the spray tip chamber 30 and deflector surface recess 38. The pre-orifice member 40 in this case has an outwardly extending, annular flange 44 at its upstream end received in a counterbore formed in the spray tip 20 for locating the upstream face of the pre-orifice member 40 flush with the upstream face of the nozzle tip 20. The discharge orifice 31 preferably has an area greater than the area of the pre-orifice 42 for insuring the free passage of the liquid entering the chamber 30.

In operation, supply liquid from the boom 10 is directed to the spray tip 20 via the stem passageway 15. Liquid entering the spray tip 20 is accelerated as is passes through the pre-orifice 42 into the expansion chamber defined by the chamber 30 and deflector surface recess 38, where the liquid is broken down and mixed with significant turbulence. Liquid particles generated within the chamber 30 are directed through the discharge orifice 31 and along the deflector surface 32 where they are broken down further for ultimate direction in a fan-shaped spray pattern having a relatively wide angle $\phi$ of between about 120–130 degrees, as illustrated in FIG. 1. As further depicted in FIG. 1, the discharging spray generates a shallow or flat bell-shaped liquid distribution curve 45, with lesser quantities of liquid being generated at opposite sides of the spray pattern, thereby enabling the discharging sprays of adjacent nozzles to be directed for slight overlap with the resulting liquid distribution across the area sprayed being substantially uniform for optimum application of agricultural chemicals and the like. The pre-orifice member 40 has been found to significantly minimize wear to the discharge orifice 31 and deflector surface 32 of the spray tip 30, and the downwardly directed discharge orifice 31 of the spray tip enables the nozzle assembly to be used for agricultural applications in both for hydraulic and air-assisted spraying modes.

Figure 4:
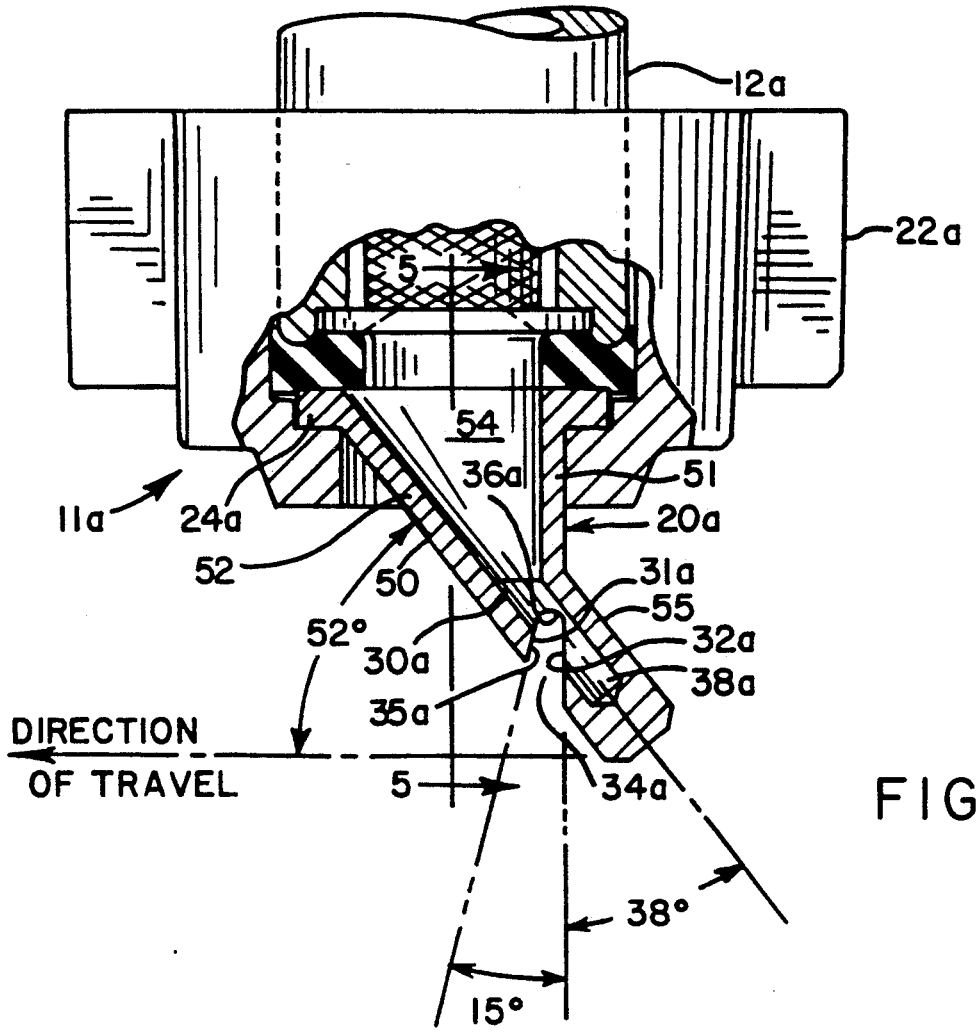
FIG. 4 is a side elevational view, in partial section, illustrating an alternative embodiment of spray nozzle assembly according to the present invention, mounted in vertically depending relation from a horizontal spray boom.
Figure 5:
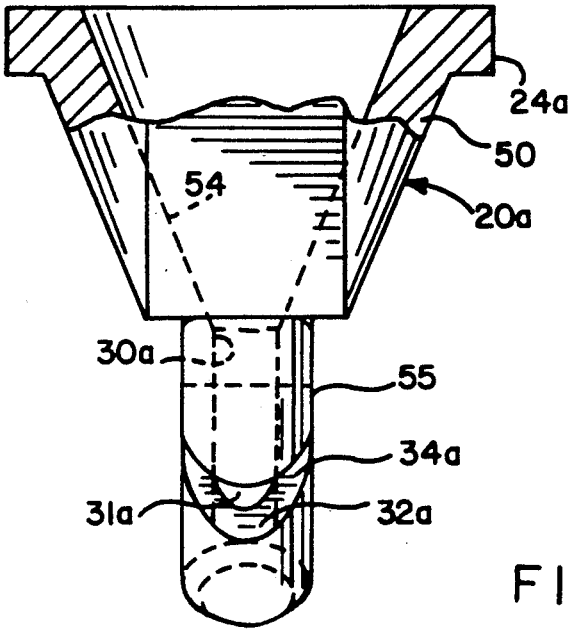
FIG. 5 is an enlarged side elevational view, in partial section, of the spray tip included in the nozzle assembly of shown in FIG. 4.

Referring now to FIGS. 4 and 5, there is shown an alternative spray nozzle assembly **11*a* in accordance with the invention that is adapted for producing a downwardly directed spray, while being mounted on a vertical stem 12*a* of a conventional horizontal spray boom. Items similar to those described above have been given similar reference numerals with the distinguishing suffix "a" added. The nozzle assembly 11*a* in this case includes a spray tip 20*a* which again has an outwardly extending mounting flange 24*a* at its upstream end to facilitate releasable securement to the stem 12*a* by a retention cap 22*a*. The spray tip 20*a* has an upper portion 50 formed by a cylindrical wall 51 on one side thereof co-axial with the stem 12***a* and a side wall 52 which extends in skewed or angular relation to the longitudinal axis of the stem, which together define an entry chamber 54 that extends downwardly and to one side, as shown in FIG. 4. The spray tip 20*a* has a cylindrical extension 55 directed downwardly and an angle to the vertical axis as an extension of the skewed side wall 52. The cylindrical spray tip extension 55 is formed with a chamber 30*a* that communicates at its upper end with the tapered entry chamber 54.

In carrying out the invention, the spray tip extension 55 is formed with an upwardly directed, substantially vertically oriented cross slot 34*a* which defines a discharge orifice 31*a* for the spray tip 20*a* and a deflection surface 32*a* for directing a discharging liquid spray in a substantially downward direction. The cross slot 34*a* has a "V" configuration with the downstream deflection surface 32*a* defined thereby being substantially vertically oriented and an upstream side or face 35*a* thereof disposed at an angle of about 15 degrees rearwardly of to the vertical. The upper end or apex of the cross slot 34*a* is in the form of a round 36*a* that extends substantially to the upper perimeter of the chamber 30*a* such that the discharge orifice 31*a* has a cross sectional area greater than the cross sectional area of the chamber 30*a* for minimizing clogging and wear about the discharge orifice 31*a* and deflector surface 32*a*, while generating a discharging spray with a spray angle of between about 120 and 130 degrees. For enhancing liquid breakdown and generation of a shallow bell-shaped liquid distribution curve, as indicated in the previous embodiment, the cross slot 34*a* is located upstream of the end of the chamber 30*a* so as to define a distinct pocket or recess 38*a* extending downstream of the deflector surface 32*a*.

Figure 6:
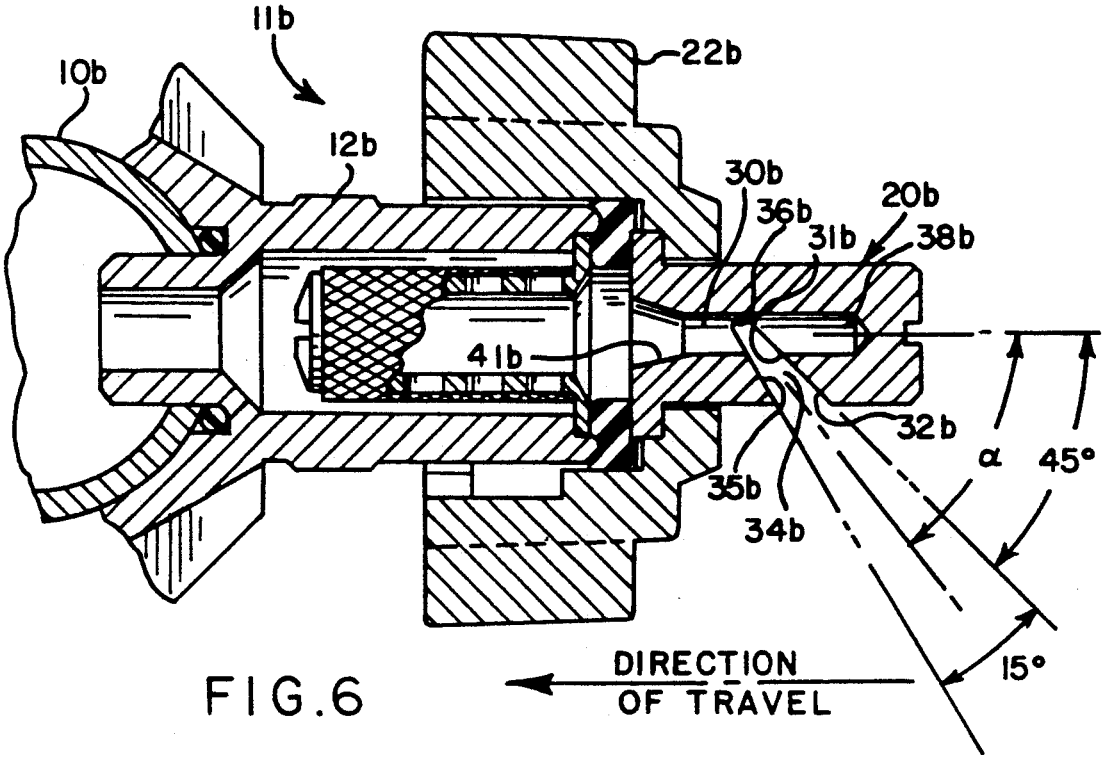
FIG. 6 is a vertical section of another embodiment of spray nozzle assembly according to the present invention.

Referring now to FIG. 6, there is shown another alternative embodiment of spray nozzle assembly 11*b* wherein items similar to those described above have been given similar reference numerals with the distinguishing suffice "b" added. The nozzle assembly 11*b* in this case includes a spray tip 20*b* mounted on a stem 12*b* extending horizontally from the liquid supply boom 10*b*. The spray tip 20*b* is formed with tapered entry throat 41*b* which communicates with an axial chamber 30*b*. The discharge orifice 31*b* in this case is defined by a cross slot 34*b* formed in the underside of the spray tip 20 at acute angle $\alpha$ of about 52½ degrees to the axis of the spray tip 20*b* and the horizontal. The cross slot 34*b* defines a downstream deflection surface 32*b* and an upstream surface 35*b* disposed at an angle of about 15 degrees to each other, resulting in the deflection surface being oriented at an angle of 45 degrees to the axis of the spray tip. The apex of the cross slot is formed with a round 36*b* in this instance extending above the axis of the spray tip chamber to about the upper perimeter thereof for causing the discharge orifice 31*b* to have an area greater than the area defined by the diameter of the chamber 30 for preventing clogging and wear in the vicinity of the cross slot 34*b* and the deflector surface 32*b*. The cross slot 34*a* again intersects the chamber 30*b* at a location intermediate its ends for defining a distinct recess or pocket 38*b* on the downstream side of the deflector surface 32*b*. With the spray tip 30*b* horizontally mounted, as illustrated in FIG. 6, the discharging spray pattern is directed in a downward and forward direction, again with a shallow bell-shaped liquid distribution curve similar to that previously described.

Figure 7:
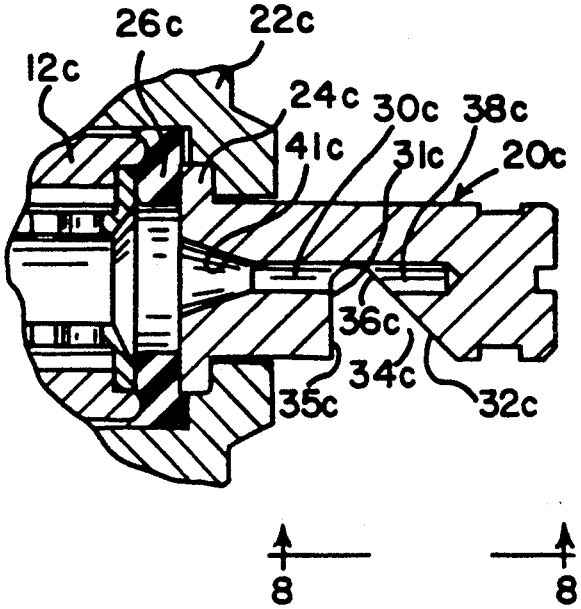
FIG. 7 is a vertical section of still another alternative embodiment of nozzle assembly according to the present invention.
Figure 8:
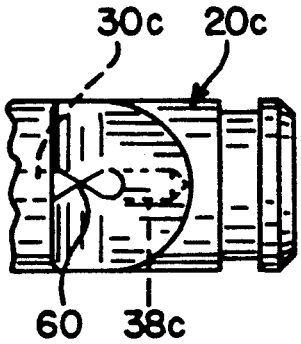
FIG. 8 is a bottom view of the spray tip included in the nozzle assembly shown in FIG. 7.

Referring now to FIGS. 7 and 8, there is shown still another alternative embodiment of spray nozzle assembly according to the present invention wherein items similar to those described above have been given similar reference numerals with the distinguishing suffix "c" added. The spray tip 20*c* again has a mounting flange 24*c* for securement to a horizontal stem of a spray boom. The spray tip 20*c* is formed with an inwardly tapered entry throat 41*c* communicating with an axial chamber 30*c*. A cross slot 34*c* in the underside of the spray tip defines a discharge orifice 31*c*, a downstream deflection surface 32*c* in this instance disposed at an angle of about 45 degrees to the horizontal, and a vertical upstream face 35*c*. The upstream and downstream faces 35*c*, 32*c* defined by the cross slot 34*c* have an apex in the form of a round 36*c* that extends about to the upper perimeter of the chamber 30*c* intermediate the ends thereof for defining a recess or pocket 38*a* downstream of the deflection surface 32*c*. In the event that the spray tip 20*c* is machined from metal stock, the depth of the cross slot 34 can be easily determined by the machine operator by viewing the point of tangency 60 of the cross slot 34 with the upper perimeter of the chamber 30, as shown in FIG. 8. The round 36*c* in this instance has a radius which is about the about twice the diameter of the chamber 30*c* for defining a discharge orifice 31*c* with significantly greater area than the diameter of the chamber for permitting free passage of solids containing liquids and for minimizing wear in the area of the discharge orifice and deflection surface, while at the same time generating a relatively wide angle spray pattern with a shallow bell-shaped liquid distribution curve substantially similar to that previously described.

Figure 9:
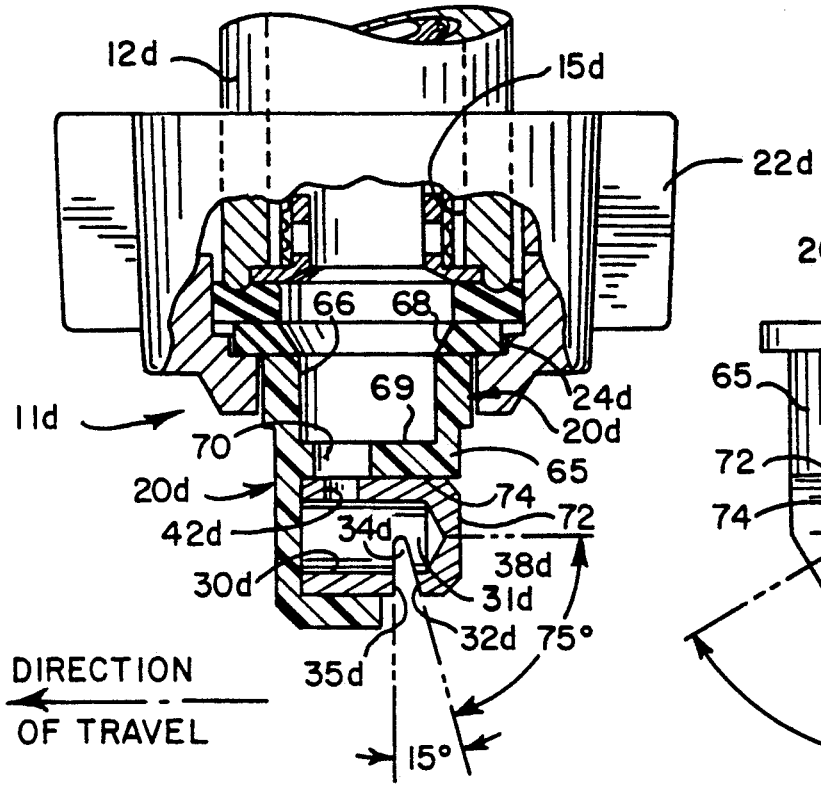
FIG. 9 is a side elevational view, in partial section, of still a further alternative embodiment of the spray nozzle assembly according to the present invention.
Figure 10:
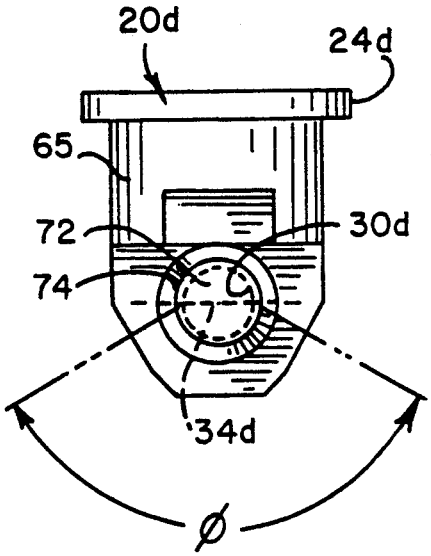
FIG. 10 is an right-side elevational view of the spray tip of the nozzle assembly shown in FIG. 9.

Referring now to FIGS. 9–10, there is shown a further alternative spray nozzle assembly wherein items similar to those described above have been given similar reference numerals with the distinguishing suffix "d" added. The spray nozzle assembly 11*d* in this case includes a spray tip 20*d* having a body 65, preferably molded of plastic, formed with an outwardly extending mounting flange 24*d* at its upstream end for releasable securement to a stem 12*d* by a retention cap 22*d*. The spray tip body 65 has an upper end formed with a first cylindrical chamber 66 communicating at an upstream end with a stem passageway 15*d* through a tapered throat 68. The first cylindrical chamber 66 has a vertical axis coincident with the axis of the stem passageway 15*d* and a bottom or end wall 69 formed with an eccentrically located outlet passage 70 substantially smaller than the diameter of the chamber 66.

In accordance with a further feature of the invention, the spray tip 20*d* has a metallic tip insert 72 which is horizontally supported in the lower end of the body 65 and formed with an elongated cylindrical expansion chamber 30*d* having a small diameter preorifice 42*d* in a side wall thereof adjacent an upstream end communicating with the first chamber outlet passage 70. The preorifice 42*d* in this case is smaller than the first chamber outlet passage 70 such that the discharge passage 70 defines an entry passage to the preorifice 42*d*. The expansion chamber 30*d* has a cylindrical configuration with an axis at an angle, in this case perpendicular, to the axis of the first chamber 66 and the preorifice 42*d* is formed in a top side of the insert 72 adjacent the upstream end.

For supporting the tip insert 72, the spray tip body 65 is formed with a cylindrical cavity 74 opening to one side thereof and the spray tip insert 72 is mounted within the cavity 74 with a downstream end extending out the open side. The insert 72 preferably is press fit within the cavity 74.

For defining a discharge orifice 31*d* for the nozzle assembly and a deflection surface 32*d* for directing a discharging liquid spray in a substantially downward direction, the spray tip insert 72 is formed with a substantially vertically oriented cross-slot 34*d* which extends through an exposed underside of the insert 72 adjacent an end of the chamber 30*d* opposite the preorifice 42*d*. The cross-slot 34*d* has a "V" configuration with an upstream face 35*d* thereof vertically oriented and a downstream face 32*d* disposed at an angle of about 15 degrees to the vertical. The upper end or apex of the cross-slot 34*d* is in the form of a round that extends about to the horizontal axis of the spray tip insert expansion chamber 30*d*. For enhancing liquid breakdown and generation of a shallow liquid distribution curve, the cross-slot 34*d* is located upstream of the end of the chamber 30*d* so as to define a distinct pocket or recess 38*d* extending downstream of the deflector surface 32*d*. The discharge orifice 31*d* preferably has an area equal to or greater than the area of the preorifice 42*d* for ensuring the free passage of the liquid entering the chamber 30*d*.

It will be appreciated by one skilled in the art that while the spray tip 20*d* may be mounted on a vertically oriented stem 12*d* for downwardly directed spraying, the tip 20*d* nevertheless has a relatively simple and compact design. Moreover, while the plastic spray tip body 65 lends itself to economical manufacture, the metallic spray tip insert 72 permits long term wear resistance usage of the nozzle assembly lid.

Figure 11:
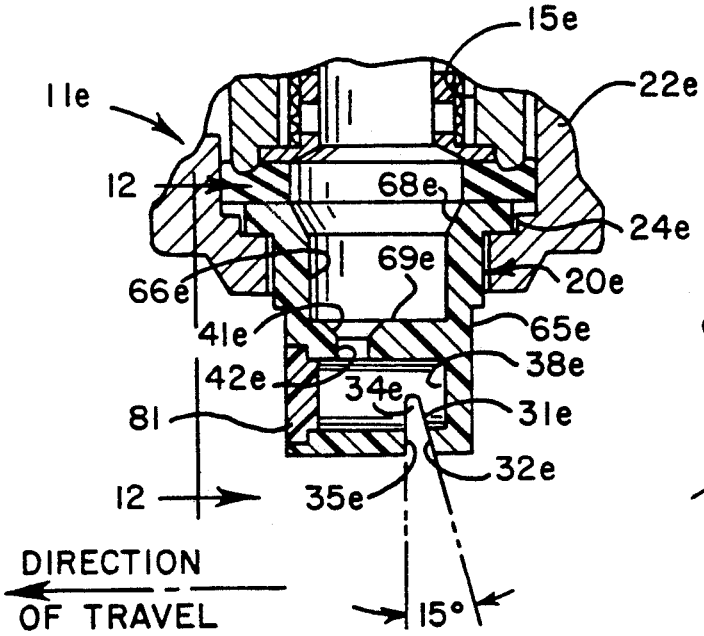
FIG. 11 is a fragmentary vertical section of another alternative embodiment of the spray nozzle assembly.
Figure 12:
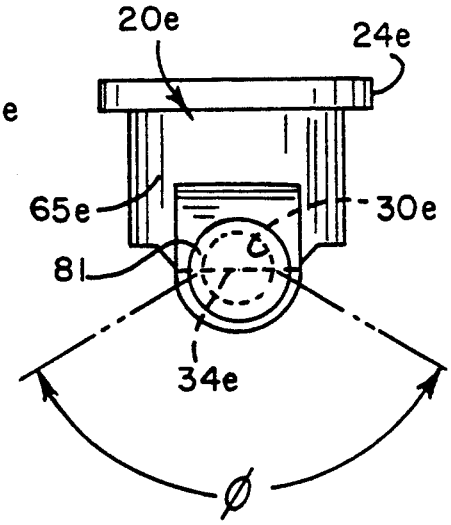
FIG. 12 is a right-side elevational view of the spray tip of the nozzle assembly shown in FIG. 11.

Referring now to FIGS. 11–12, there is shown a spray nozzle assembly 11*e*, substantially similar to that shown in FIGS. 9–10, but formed entirely of plastic. The spray nozzle assembly 11*e* includes a spray tip 20*e* having a body 65*e* formed with a first vertically oriented, cylindrical chamber 66*e* having a tapered entry throat 68*e* at an upstream end. The chamber 66*e* has a bottom or end wall 69*e* in this case directly formed with a preorifice 42*e* disposed in off centered relation to the axis of the chamber 66*e*. The preorifice 42*e* has a tapered upstream entry throat 41*e*.

In accordance with a feature of this embodiment of the invention, the nozzle body 65*e* defines a second cylindrical expansion chamber 30*e* disposed below the first chamber 66*e* with the preorifice 42*e* communicating with a top side of the expansion chamber 30*e* adjacent an upstream end thereof. The nozzle body 65*e* further is formed with a discharge orifice 31*e* defined by a cross-slot 34*e* extending upwardly from an underside of the nozzle body 65*e* adjacent an end of the horizontal chamber 30*e* opposite that of the preorifice 42*e*. The discharge orifice 31*e* again has an upstream face 35*a* that is vertically oriented and a downstream face 32*e* disposed at a small angle to the vertical, such as 15 degrees. The cross-slot 34*e* is disposed upstream of the end of the expansion chamber 30*e* so as to define a distinct pocket or recess 38*e* downstream of the deflector surface 32*e*. To facilitate plastic injection molding of the nozzle body 65, it will be appreciated by one skilled in the art that the plastic body 65 may be formed with the second chamber 30*e* open at one end, such as at the upstream end, which can thereafter be closed by a plastic plug 81, which may be secured by ultrasonic welding.

From the foregoing it can be seen that the spray nozzle assembly of the present invention is particularly adaptable for spraying agricultural chemicals with a substantially uniform liquid distribution over the area being sprayed. The nozzle assembly may be used in both purely hydraulic and air-assisted spray applications, and in the latter case, is easily adaptable for directing discharging sprays in a substantially straight downward direction. The nozzle is less susceptible to undesirable wear and clogging.

I claim:

1. A spray nozzle assembly comprising, stem means defining a passage through which a supply liquid is directed, a spray tip, means for mounting said spray tip on said stem means for receiving supply liquid from said passage and for directing the liquid in a pre-determined spray pattern, said spray tip being formed with a substantially horizontal elongated expansion chamber communicating with said passage, and said spray tip being formed with a cross-slot which intersects an underside of said chamber at a location adjacent a downstream end thereof for defining a discharge orifice, a deflection surface on a downstream side of said discharge orifice for directing liquid discharging from said orifice in a direction transverse to the axis of said chamber, and a pocket extending downstream of said deflection surface, and said spray tip having a pre-orifice substantially smaller in diameter than the diameter of said expansion chamber communicating through an upper side of said elongated chamber adjacent an upstream end thereof.

2. The spray nozzle assembly of claim 1 in which said expansion chamber has a diameter at least twice the diameter of said preorifice.

3. A spray nozzle assembly comprising, stem means defining a passage through which a supply liquid is directed, a spray tip, means for mounting said spray tip on said stem means for receiving supply liquid from said passage and for directing the liquid in a pre-determined spray pattern, said spray tip having an elongated cylindrical expansion chamber communicating with said passage, said spray tip having a cross-slot which intersects a side of said elongated cylindrical expansion chamber at a location adjacent a downstream end thereof for defining a discharge orifice, a deflection surface ion a downstream side of said discharge orifice for directing liquid discharging from said orifice in a direction transverse to the axis of said chamber, and a pocket extending downstream of said deflection surface, and means defining a preorifice substantially smaller in diameter than the diameter of said expansion chamber communicating through a side of said elongated cylindrical expansion chamber at a location adjacent an upstream end thereof for directing liquid into said expansion chamber.

4. The spray nozzle assembly of claim 3 in which said spray tip includes means defining a second chamber upstream of said expansion chamber communicating with said expansion chamber through said preorifice defining means.

5. The spray nozzle assembly of claim 4 in which said second chamber has a vertical axis.

6. A spray nozzle assembly for mounting on a spray boom through which a supply liquid is directed comprising, a stem mounted on said boom and having a liquid passage for receiving supply liquid from said boom, a spray tip, means for mounting said spray tip on said stem for receiving supply liquid from said stem passage and for directing the liquid in a pre-determined spray pattern, said spray tip being formed with a first cylindrical chamber in communication with said stem passage, said spray tip having a cylindrical second chamber with an axis at an angle to the axis of said first cylindrical chamber and communicating with said first chamber through a preorifice disposed adjacent one end of said second chamber, said preorifice being substantially smaller in diameter than the diameter of said second chamber, and means defining a cross-slot which intersects said second chamber at a location adjacent an end of said second chamber opposite said preorifice for forming a liquid discharge orifice, a deflection surface on a downstream side of said discharge orifice for directing liquid discharging from said discharge orifice, and a pocket extending downstream of said deflection surface.

7. The spray nozzle assembly of claim 6 in which said first cylindrical chamber has a vertical axis.

8. The spray nozzle assembly of claim 7 in which said second chamber axis is perpendicular to said first chamber axis.

9. The spray nozzle assembly of claim 6 in which said spray tip includes a plastic body formed with said first chamber, said plastic body further being formed with a cavity communicating with said first chamber through an aperture in said body adjacent an end of said cavity, a spray tip insert mounted within said cavity and defining said second chamber, said preorifice being formed in said spray tip insert and communicating with said first chamber through said aperture, and said discharge orifice being formed in said spray tip insert at a location outside said cavity.

10. The spray nozzle assembly of claim 9 in which said second chamber has a horizontal axis, said preorifice extends through a top side of said second chamber, and said discharge orifice communicates with said second chamber from an underside thereof.

11. The spray nozzle assembly of claim 9 in which said spray tip insert is formed of metal.

12. A spray nozzle assembly comprising, vertically oriented stem means defining a passage through which a supply liquid is directed, a spray tip, means for mounting said spray tip on said stem means for receiving supply liquid from said passage and for directing the liquid in a pre-determined spray pattern, said stray tip being formed with an elongated expansion chamber communicating with said passage and having an axis disposed at an angle to the vertical, said spray tip being formed with a cross-slot which extends substantially vertically upwardly into an underside of said expansion chamber at a location intermediate opposite ends thereof for defining a discharge orifice, a deflection surface on a downstream side of said discharge orifice for directing liquid discharging from said orifice in a direction transverse to the axis of said chamber, and a pocket extending downstream of said deflection surface, and said spray tip having a preorifice upstream of said discharge orifice and of a diameter no greater than one half the diameter of said expansion chamber for communicating liquid between said passage and elongated chamber.

13. A spray nozzle assembly comprising, steam means defining a passage through which a supply liquid is directed, a spray tip, means for mounting said spray tip on said stem means for receiving supply liquid from said passage and for directing the liquid in a pre-determined spray pattern, said spray tip having an elongated expansion chamber communicating with said passage, said spray tip a cross-slot which intersects said elongated expansion chamber at a location intermediate opposite ends thereof for defining a discharge orifice, a deflection surface on a downstream side of said discharge orifice for directing liquid discharging from said orifice in a direction transverse to the axis of said chamber, and a pocket extending downstream of said deflection surface, means defining a preorifice upstream of said discharge orifice and substantially smaller in diameter than the diameter of said expansion chamber for directing liquid into said expansion chamber, said spray tip having a second chamber upstream of said expansion chamber communicating with said expansion chamber through said preorifice defining means, said second chamber being cylindrical, and said expansion chamber being cylindrical and having an axis at an angle to an axis of said second cylindrical chamber.

14. The spray nozzle assembly of claim 13 in which said spray tip has a plastic body in which said expansion and second chambers are formed.

15. A spray nozzle assembly comprising, stem means defining a passage through which a supply liquid is directed, a spray tip, means for mounting said spray tip on said stem means for receiving supply liquid from said passage and for directing the liquid in a pre-determined spray pattern, said spray tip having a body formed with an upstream chamber communicating with said passage, said body further being formed with a cavity communicating with said upstream chamber through an aperture in said body adjacent an end of said cavity, a spray tip insert mounted within said cavity, said spray tip insert being formed with an elongated expansion chamber, said spray tip insert further having a cross-slot which intersects said elongated expansion chamber at a location intermediate opposite ends thereof for defining a discharge orifice at a location outside of said cavity, a deflection surface on a downstream side of said discharge orifice for directing liquid discharging from said orifice in a direction transverse to the axis of said expansion chamber, and a pocket extending downstream of said deflection surface, and said spray tip insert further being formed with a preorifice upstream of said discharge orifice and substantially smaller in diameter than the diameter of said expansion chamber, said preorifice communicating with said upstream chamber through said aperture for directing liquid into said expansion chamber.

16. The spray nozzle assembly of claim 15 in which said spray tip body is made of plastic.

17. The spray nozzle assembly of claim 16 in which said expansion chamber has a horizontal axis, said preorifice communicates with said expansion chamber through a top side thereof, and said discharge orifice communicates with said expansion chamber from an underside thereof.

18. A spray nozzle assembly for mounting on a spray boom through which a supply liquid is directed comprising, a stem mounted on said boom and having a liquid passage for receiving supply liquid form said boom, a spray tip having a one-piece body, means for mounting said spray tip on said stem for receiving supply liquid from said stem passage and for directing the liquid in a pre-determined spray pattern, said spray tip body being formed with a first chamber communication with said stem passage, said spray tip body being formed with a second chamber communicating with said first chamber through a preorifice disposed adjacent one end of said second chamber, said preorifice being substantially smaller in diameter than the diameter of said second chamber, said spray tip body having a plug affixed thereto enclosing one end of said chamber, and means defining a cross-slot which intersects said second chamber at a location adjacent an end of said second chamber opposite said preorifice for forming a liquid discharge orifice, a deflection surface on a downstream side of said discharge orifice for directing liquid discharging from said discharge orifice, and a pocket extending downstream of said deflection surface.

19. The spray nozzle assembly of claim 18 in which said plug encloses an upstream end of said second chamber.

20. The spray nozzle assembly of claim 18 in which said body defines said preorifice.

21. The spray nozzle assembly of claim 20 in which said preorifice communicates through a side of said second chamber near the upstream end thereof.

22. The spray nozzle of claim 21 in which said preorifice has an inwardly tapered entry throat.

* * * * *